US006430764B1

(12) United States Patent
Peters

(10) Patent No.: US 6,430,764 B1
(45) Date of Patent: Aug. 13, 2002

(54) HERBAL-SCENTED PILLOW

(76) Inventor: Nancylou E. Peters, HC 64 Box 234 B, Wellsville, NY (US) 14895

( * ) Notice: Subject to any disclaimer, the term of this patent is extended or adjusted under 35 U.S.C. 154(b) by 0 days.

(21) Appl. No.: 09/569,449

(22) Filed: May 12, 2000

(51) Int. Cl.[7] ..... A47G 9/00
(52) U.S. Cl. ..... 5/641; 5/948; 5/951
(58) Field of Search ..... 5/636, 641, 951, 5/645, 948; 604/19, 289; 119/28.5

(56) References Cited

U.S. PATENT DOCUMENTS 3,858,257 A 1/1975 Young
4,763,604 A 8/1988 Meekins
5,299,335 A * 4/1994 Ivester et al. ..... 5/641
5,363,524 A 11/1994 Lang
5,522,105 A * 6/1996 Fujiwara et al. ..... 5/641
5,706,535 A * 1/1998 Takashima ..... 5/641
5,819,347 A * 10/1998 Masuda ..... 5/641
D400,664 S 11/1998 Rosenstadt et al.
5,918,333 A * 7/1999 Takashima ..... 5/641

* cited by examiner

*Primary Examiner*—Jack Lavinder
*Assistant Examiner*—Fredrick Conley

(57) ABSTRACT

A herbal-scented pillow for soothing and revitalizing the user with herbal aromas. The herbal-scented pillow includes a bag member essentially made of fabric material; and also includes one or more pouch members being securely disposed inside the bag member; and further includes stuffing materials disposed within the bag member to effectively fill and cushion the bag member; and also includes one or more scent-emitting substances disposed inside each pouch member.

1 Claim, 2 Drawing Sheets

FIG. 1
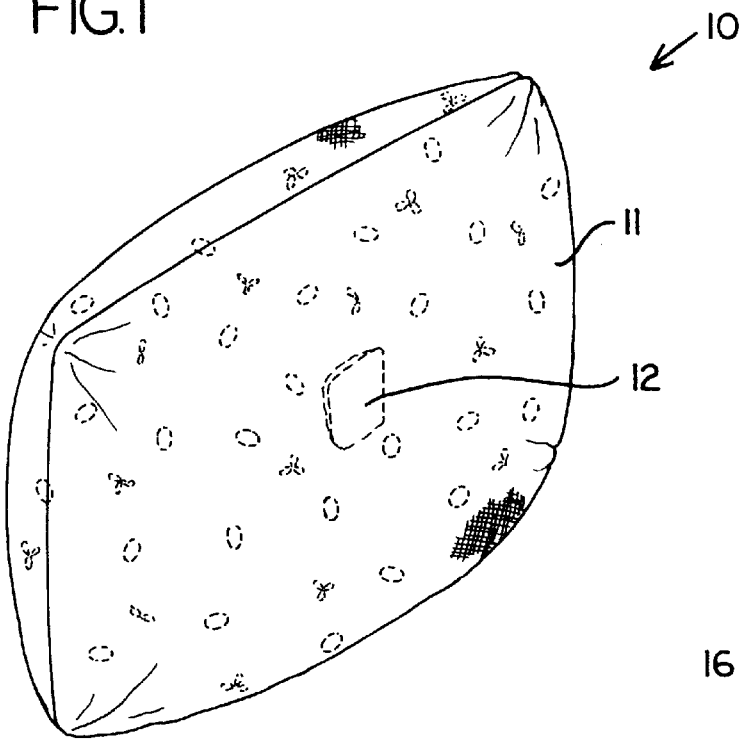
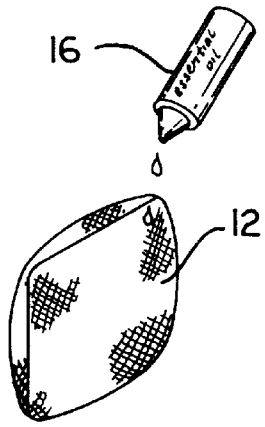
FIG. 3
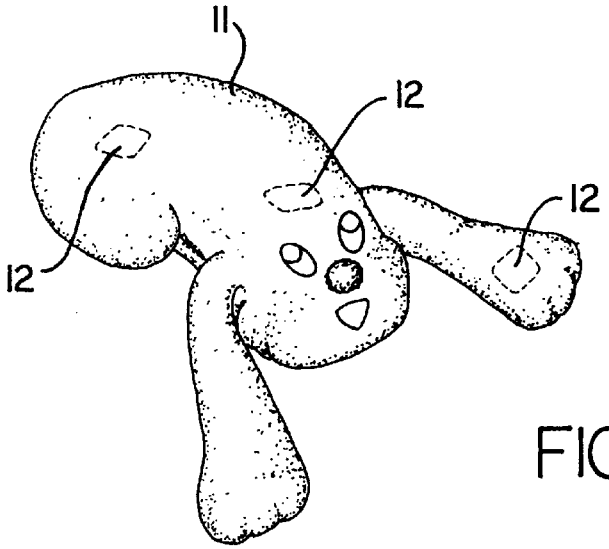
FIG. 4

10

11
13
12
15
14
13
11

HERBAL-SCENTED PILLOW

BACKGROUND OF THE INVENTION

1. Field of the Invention

The present invention relates to aroma-emitting pillow and more particularly pertains to a new herbal-scented pillow for soothing and revitalizing the user with herbal aromas.

2. Description of the Prior Art

The use of aroma-emitting pillow is known in the prior art. More specifically, aroma-emitting pillow heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,522,105; U.S. Pat. No. 5,299,335; U.S. Pat. No. Des. 400,664; U.S. Pat. No. 4,763,604; U.S. Pat. No. 5,363,524; and U.S. Pat. No. 3,858,257.

While these devices fulfill their respective, particular objectives and requirements, the aforementioned patents do not disclose a new herbal-scented pillow. The inventive device includes a bag member essentially made of fabric material; and also includes one or more pouch members being securely disposed inside the bag member; and further includes stuffing materials disposed within the bag member to effectively fill and cushion the bag member; and also includes one or more scent-emitting substances disposed inside each pouch member.

In these respects, the herbal-scented pillow according to the present invention substantially departs from the conventional concepts and designs of the prior art, and in so doing provides an apparatus primarily developed for the purpose of soothing and revitalizing the user with herbal aromas.

SUMMARY OF THE INVENTION

In view of the foregoing disadvantages inherent in the known types of aroma-emitting pillow now present in the prior art, the present invention provides a new herbal-scented pillow construction wherein the same can be utilized for soothing and revitalizing the user with herbal aromas.

The general purpose of the present invention, which will be described subsequently in greater detail, is to provide a new herbal-scented pillow apparatus and method which has many of the advantages of the aroma-emitting pillow mentioned heretofore and many novel features that result in a new herbal-scented pillow which is not anticipated, rendered obvious, suggested, or even implied by any of the prior art aroma-emitting pillow, either alone or in any combination thereof.

To attain this, the present invention generally comprises a bag member essentially made of fabric material; and also includes one or more pouch members being securely disposed inside the bag member; and further includes stuffing materials disposed within the bag member to effectively fill and cushion the bag member; and also includes one or more scent-emitting substances disposed inside each pouch member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new herbal-scented pillow apparatus and method which has many of the advantages of the aroma-emitting pillow mentioned heretofore and many novel features that result in a new herbal-scented pillow which is not anticipated, rendered obvious, suggested, or even implied by any of the prior art aroma-emitting pillow, either alone or in any combination thereof.

It is another object of the present invention to provide a new herbal-scented pillow which may be easily and efficiently manufactured and marketed.

It is a further object of the present invention to provide a new herbal-scented pillow which is of a durable and reliable construction.

An even further object of the present invention is to provide a new herbal-scented pillow which is susceptible of a low cost of manufacture with regard to both materials and labor, and which accordingly is then susceptible of low prices of sale to the consuming public, thereby making such herbal-scented pillow economically available to the buying public.

Still yet another object of the present invention is to provide a new herbal-scented pillow which provides in the apparatuses and methods of the prior art some of the advantages thereof, while simultaneously overcoming some of the disadvantages normally associated therewith.

Still another object of the present invention is to provide a new herbal-scented pillow for soothing and revitalizing the user with herbal aromas.

Yet another object of the present invention is to provide a new herbal-scented pillow which includes a bag member essentially made of fabric material; and also includes one or more pouch members being securely disposed inside the bag member; and further includes stuffing materials disposed within the bag member to effectively fill and cushion the bag member; and also includes one or more scent-emitting substances disposed inside each pouch member.

Still yet another object of the present invention is to provide a new herbal-scented pillow that effects healthful benefits through the herbal aromas being dispensed from the pillow.

Even still another object of the present invention is to provide a new herbal-scented pillow that freshens the home with herbal scents being given off by the pillow rather than other scent-emitting devices.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new herbal-scented conventionally-shaped pillow according to the present invention.

FIG. 3 is a detailed perspective view of a pouch member of the present invention.

FIG. 4 is a perspective view of a dog-shaped pillow of the present invention.

DESCRIPTION OF THE PREFERRED EMBODIMENT

Figure 2:
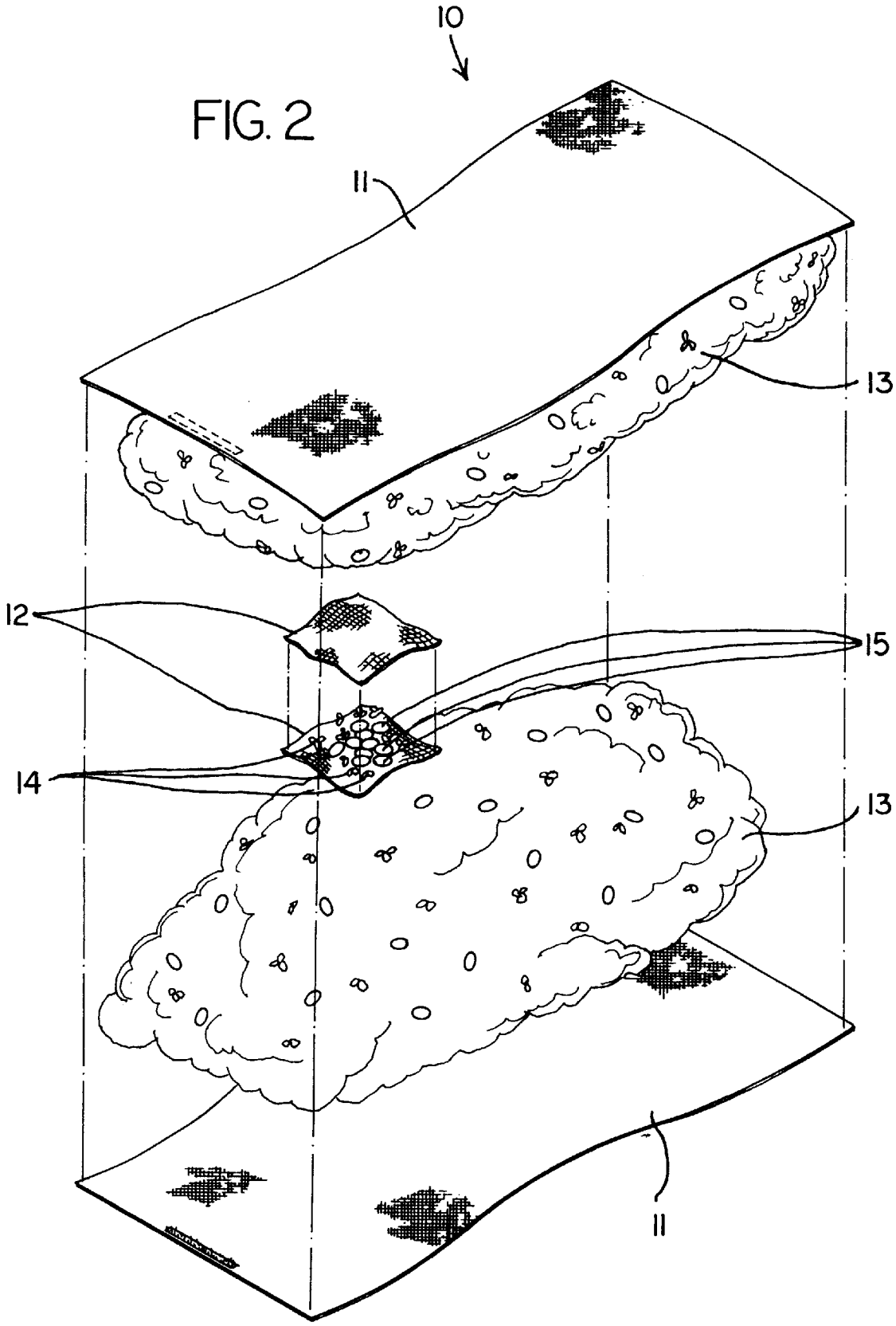
FIG. 2 is an exploded perspective view of the present invention.

With reference now to the drawings, and in particular to FIGS. 1 through 4 thereof, a new herbal-scented pillow embodying the principles and concepts of the present invention and generally designated by the reference numeral 10 will be described.

As best illustrated in FIGS. 1 through 4, the herbal-scented pillow 10 generally comprises a bag member 11 made of essentially fabric material with the bag member 11 being capable of having many different shapes and forms such as hearts, dogs, cats, seals, sea lions, penguins, and whales. The bag member 11 has a length ranging from 14 to 36 inches and a width ranging from 5 to 10 inches.

One or more pouch members 12 are being securely and conventionally disposed inside the bag member 11. Each pouch member 12 is substantially smaller than the bag member 11 and is made of fabric material with each pouch member 12 having a length of approximately 3 inches and a width of approximately 2inches.

Stuffing materials 13 are conventionally disposed within the bag member 11 to effectively fill and cushion the bag member 11 with the stuffing materials 13 including non-allergic polyester fibers.

One or more scent-emitting substances 14 are conventionally disposed inside each pouch member 12. The one or more scent-emitting substances 14 include herbs for soothing and calming relief to a user with the herbs including buckwheat hulls 15. The one or more pouch members 12 are centrally-disposed inside the bag member 11 and are adapted to be replenished and injected by an injecting member 16 such as a syringe with essential oils to effect a scent being given off.

In use, when using the herb-scented pillow 10, the user smells and takes in the aroma given off by the herbs 14 disposed in the pouch members 12. Such aromas provide therapeutic benefits by relaxing and calming the user and by stimulating the user with the herbs 14 containing peppermint. Such aromas also freshens any areas of the home.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A herbal-scented pillow comprising:

a bag member made of essentially fabric material and having an interior, said bag member being capable of having many different shapes and forms, said bag member having a length ranging from 14 to 36 inches and a width ranging from 5 to 10 inches;

one or more pouch members being disposed inside the interior of said bag member, each said pouch member being substantially smaller than said bag member and being made of fabric material, each said pouch member having a length of approximately 3 inches and a width of approximately 2 inches;

stuffing materials disposed within the interior of said bag member to effectively fill and cushion said bag member, said stuffing materials including non-allergic polyester fibers; and one or more scent-emitting substances disposed inside each said pouch member, said one or more scent-emitting substances including herbs for soothing and calming relief to a user, said herbs including buckwheat hulls, said one or more pouch members being centrally disposed inside said bag member and being adapted to be replenished and injected with essential oils to effect a scent being given off;

wherein said one or more pouch members are free of any connection to an interior surface of said bag member such that said one or more pouch members are free to move about the interior of said bag member.

* * * * *